United States Patent [19]

Di Blasio

[11] 4,114,870

[45] Sep. 19, 1978

[54] DOCUMENT HANDLING AND COUNTING DEVICE HAVING GUIDE FINGERS FOR FACILITATING THE FEEDING OF CURLED, FOLDED AND CREASED DOCUMENTS AND FURTHER HAVING IMPROVED OUTFEED STACKER MEANS FOR FACILITATING THE NEAT STACKING OF DOCUMENTS OF THE AFOREMENTIONED TYPE

[75] Inventor: John A. Di Blasio, Pennsauken, N.J.

[73] Assignee: Brandt-Pra, Inc., Cornwells Heights, Pa.

[21] Appl. No.: 704,467

[22] Filed: Jul. 12, 1976

[51] Int. Cl.[2] ..... B65H 3/04

[52] U.S. Cl. ..... 271/35; 271/122; 271/124; 271/161; 271/165

[58] Field of Search ..... 271/3, 4, 6, 7, 34, 271/35, 37, 121, 122, 124, 125, 161, 165, 167

[56] References Cited

U.S. PATENT DOCUMENTS

| | | | |
|---|---|---|---|
| 1,116,860 | 11/1914 | Trundle | 271/122 |
| 1,646,883 | 10/1927 | Sheldrick | 271/122 |
| 2,273,288 | 2/1942 | Rouan | 271/35 |
| 3,126,199 | 3/1964 | Rosoff | 271/35 X |
| 3,260,521 | 7/1966 | Moxness | 271/121 X |
| 3,870,294 | 3/1975 | Donner | 271/165 X |
| 3,944,210 | 3/1976 | McInerny | 271/35 X |
| 3,970,298 | 7/1976 | Irvine et al. | 271/122 X |

OTHER PUBLICATIONS

Diel et al., "Self-Adjusting Throat Guide"; IBM Technical Disclosure Bulletin, vol. 14, No. 7, p. 2240; 12-1971.

*Primary Examiner*—Robert W. Saifer
*Attorney, Agent, or Firm*—Louis Weinstein

[57] ABSTRACT

A document handling and counting device in which documents arranged in a stack within an infeed tray are bottom-fed through a document stripping and separating means so as to be fed at spaced intervals and in a one-at-a-time fashion through a document processing stage whereupon the documents are then restacked in their original order. Document stripping and separating is performed by cooperating stripper means and feed means imparting counteracting forces upon documents fed therebetween. Guide finger assemblies cooperating with the stripper means serve to fan the lower portion of the document stack preparatory to being fed between the stripper means and drive means and are further comprised of either resilient members or resiliently mounted relatively rigid members arranged to apply a force sufficient to incoming documents between the stripper and the drive means even in the event that the documents are curled, folded or creased and are further adapted to yield and thereby reduce the force imposed upon the incoming documents to prevent the wedging and hence resulting jamming of documents.

After stripping, separation and processing of the documents, the documents are fed into an outfeed stacker having a guide plate designed to facilitate abrupt downward movement of the upstream ends of the documents toward the floor of the stacker in order to be assured that their upstream edges are removed from the path of incoming documents to assure neat, orderly stacking.

24 Claims, 22 Drawing Figures

FIG. 3b.
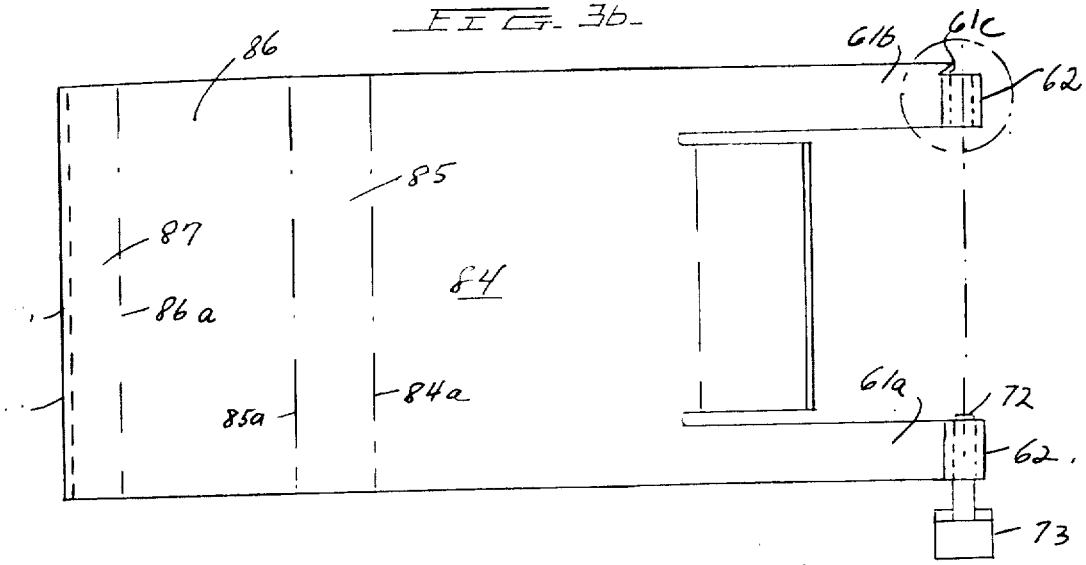
FIG. 3c.
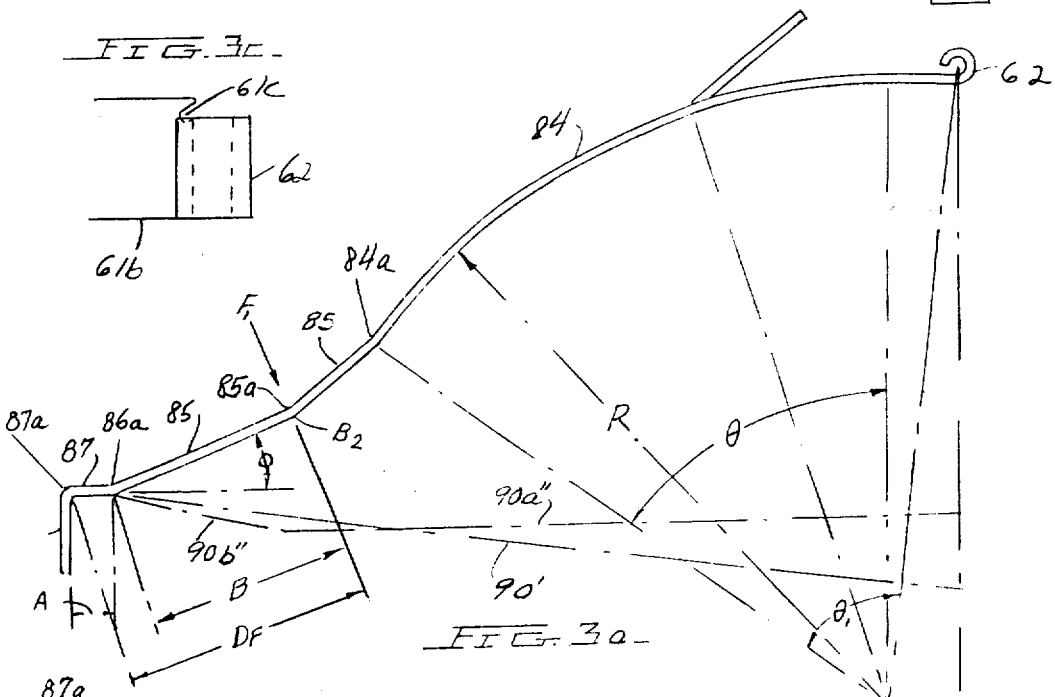
FIG. 3a.
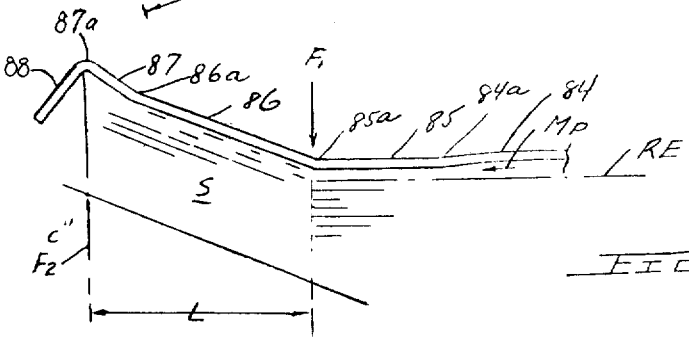
FIG. 3d.

DOCUMENT HANDLING AND COUNTING DEVICE HAVING GUIDE FINGERS FOR FACILITATING THE FEEDING OF CURLED, FOLDED AND CREASED DOCUMENTS AND FURTHER HAVING IMPROVED OUTFEED STACKER MEANS FOR FACILITATING THE NEAT STACKING OF DOCUMENTS OF THE AFOREMENTIONED TYPE

BACKGROUND OF THE INVENTION

U.S. Pat. application Ser. No. 618,280 filed Sept. 30, 1975 now U.S. Pat. No. 4,054,092 issues Oct. 18, 1977 and assigned to the assignee of the present application, teaches a document counter in which documents are bottom-fed from a stack arranged in an infeed stacker and are stripped, separated, counted and/or endorsed and then restacked in an outfeed stacker in their original order.

The sheets are fed toward the cooperating stripper means and drive means by an eccentrically mounted jogger roller which serves to jog and hence loosen the stack, as well as imparting a "kick" to the bottom-most sheet thereby advancing this sheet toward the stripper means. The stripper means is preferably comprised of a pair of assemblies each having an upstream and downstream roller of respectively larger and smaller diameters and having one or more O-rings entrained therearound for imparting reverse drive to incoming sheets due to the frictional engagement between the O-rings and the incoming sheet (or sheets).

Feed means, comprised of either one or more feed belts or a plurality of O-rings, frictionally engages the bottom-most sheet to drive this sheet in the forward feed direction. The stripper and drive belts also cooperate to "corrugate" the sheets and enhances the stripping operation. In the case where a single sheet passes between the feed stripper means, the frictional engagement between the feed belt and the sheet exceeds the frictional engagement between the stripper O-rings and the sheet causing the sheet to be moved in the forward feed direction.

In the event that two sheets are simultaneously fed together, the frictional engagement between the sheets is less than the frictional engagement between the upper sheet and the stripper O-rings, causing the top-most sheet (or sheets) to be fed in the reverse direction while the bottom-most sheet is fed in the forward feed direction, whereupon acceleration means accelerates each sheet coming under the influence of the acceleration means to provide a gap between adjacent sheets to facilitate document counting.

Documents at the bottom-most portion of the stack have their downstream edges moved toward the stripper means preparatory to a stripping operation. In the event that the downstream ends of the documents are curled, folded or creased, which occurs quite often with very thin documents, engagement of the document with the stripper O-rings occurs in a region displaced upstream from the initial point of engagement between the stripper O-rings and the drive belt causing the document (or documents) to be driven backward, severely reducing the operating effectiveness of the device.

In order to alleviate this problem, guide fingers have been provided in the immediate vicinity of the stripper roller upstream surface for guiding the downstream edges of documents downwardly toward the feed belt means in order to frictionally engage the paper documents and thereby cause the documents to be moved in the forward feed direction.

By arranging the guide fingers so that they engage the documents at a position upstream of the stripper means, in order to facilitate the handling of curled or folded document edges, it was found that if the angle between the inclined guide finger and the feed belt is too large, the documents will not be fed properly between the drive and stripper means and if the angle of inclination between the guide finger and the feed belt is too small, the documents have been found to wedge between the guide fingers and the drive belts. The design problem therefore becomes quite critical in this regard.

In the outfeed stacker, light documents have a tendency to curl or become folded more easily than stiffer documents (i.e., of the order of tab cards) so that the cumulative effect of a stack of curled documents results in the upstream edges of the documents entering into the incoming path of the document subsequently fed to the stacker impeding the entry of the incoming document and thereby preventing the formation of a neat stack.

BRIEF DESCRIPTION OF THE INVENTION

The present invention solves the infeeding and the outfeed stacking problems discussed hereinabove and is characterized by a design which includes resilient guide fingers which, while forming a rather severe acute angle with the feed belt means, are nevertheless sufficiently resilient to yield in the presence of stiff documents or in the presence of an incipient wedging condition. The resilient mount also enables the lowermost edge of the resilient guide finger to be positioned closer to the feed belt than was heretofore possible to further enhance the downward force exerted on the documents and hence enhance the frictional drive imparted to documents by the drive belts.

The stacker is characterized by providing a generally S-shaped guide plate which is designed to exert a torque-like force upon incoming documents to snap the downstream edge upwardly and thereby flip the upstream (i.e., rear) end of the document out of the way of the next document fed into the stacker in order to insure that the documents will be fed and stacked in an orderly manner. In order to further increase the torque-like force imparted to documents, the floor of the stacker or a portion thereof may be inclined to provide a companion torque-like action which further acts to snap the forward end of the document and thereby enhances the snapping downward movement of the upstream end of the document to assure that it will be displaced from the path of movement of documents subsequently fed into the stacker.

The stacker guide plate is further provided with a spring loading means for reducing the weight of the guide plate exerted upon the stack. The spring is of significantly increased length in order to maintain the lifting force imparted to the guide plate by the spring means substantially constant over the range of movement of the guide plate as the stack builds thereby assuring the application of uniform torque-like forces upon the incoming sheets regardless of the height of the guide plate as the stack is being formed and hence the stack height is increasing.

OBJECTS OF THE INVENTION AND BRIEF DESCRIPTION OF THE FIGURES

It is therefore one object of the present invention to provide novel resilient guide finger means adapted to provide the positive and proper feeding of documents through the document handling device utilizing the guide fingers, regardless of the thickness and/or stiffness of the documents and regardless of the condition of the documents, be they curled and either slightly or severely creased or folded.

The above as well as other objects of the present invention will become apparent when reading the accompanying description and drawing in which:

FIG. 1*a* shows an elevational view of a document handling and counting device embodying the principles of the present invention.

FIG. 1*b* shows a top view of the arrangement of FIG. 1*a*.

FIG. 1*c* shows a sectional view of a portion of the apparatus of FIG. 1*a* looking in the direction of arrows 1*c*—1*c*.

FIGS. 2*a* and 2*b* show side and front views respectively, of one of the guide finger arrangements of FIGS. 1*a* and 1*b*.

FIGS. 3*a* and 3*b* show side and top views respectively, of the stacker guide plate of FIGS. 1*a* and 1*b*.

FIG. 3*c* shows an enlarged detailed view of the encircled portion of FIG. 3*a*.

FIG. 3*d* shows an enlarged detailed portion of the stacker guide plate of FIG. 3*a* and which is useful in explaining the mode of operation.

FIGS. 4*a* and 4*b* show detailed elevational and top views of the assembly for adjusting the spring force applied to the stacker guide plate.

FIGS. 5*a*-5*b* through 7*a*-7*b* respectively show side and front views of alternative embodiments for the guide finger of FIGS. 2*a* and 2*b*.

FIGS. 8*a* and 8*b* are side and front views of another guide finger assembly of the present invention.

FIG. 8*c* shows a view of the structure of FIG. 8*b* looking in the direction of arrows 8*c*—8*c*.

FIGS. 9 and 10 are side elevational views of still further embodiments of the present invention.

DETAILED DESCRIPTION OF THE INVENTION

The aforementioned copending application Ser. No. 618,820 now U.S. Pat. No. 4,054,092 shows a perspective view of the document handling and counting device of the present invention in FIG. 1 thereof.

Figures 1A, 1C:
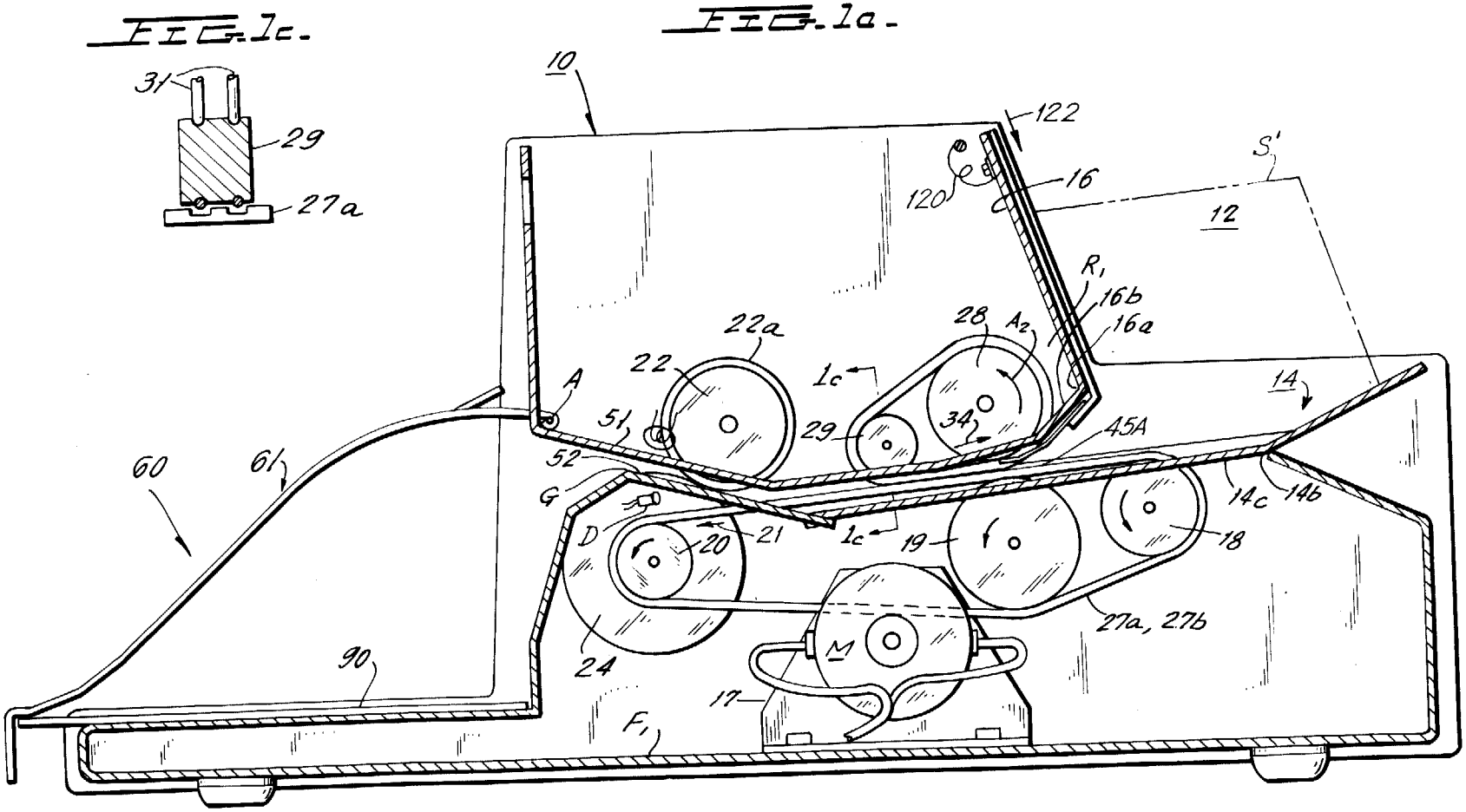
Figure 1B:
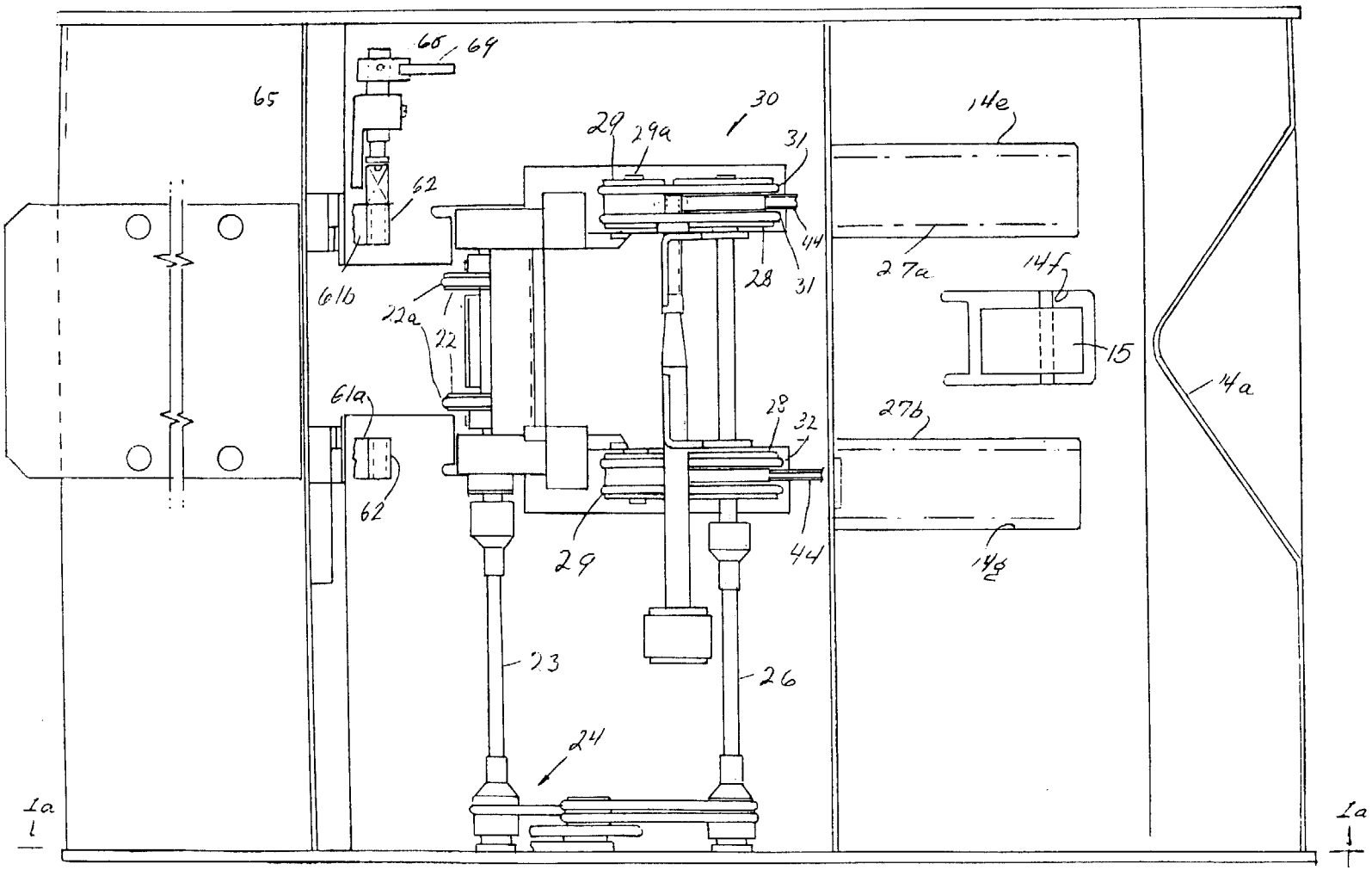
Figure 2B:
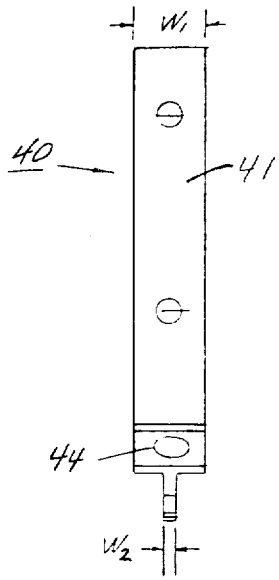
Figure 2A:
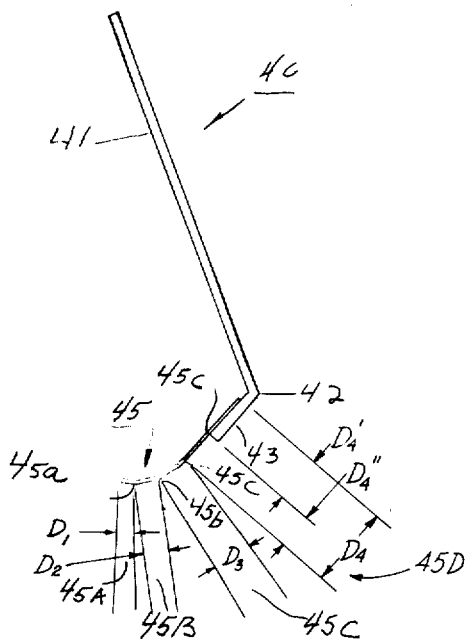

FIGS. 1*a* and 1*b* of the present application show elevational and top plan views of the device of FIG. 1 of the aforementioned copending application and incorporating the novel features of the present invention, FIG. 1*a* of the present application being substantially similar to FIG. 2*a* of the aforementioned copending application.

Making reference to FIGS. 1*a* and 1*b* of the present application, the document handling and counting apparatus 10 comprises an infeed section 12 adapted to receive stacks of documents which may be of intermixed sizes, finishes, thicknesses and/or stiffnesses. The documents are bottom-fed by the apparatus 10 in an efficient high-speed manner without the need for any top weight. An inclined support plate 14 provided in the infeed stacker 12 has a large V-shaped notch 14*a* facilitating the placement and/or removal of a stack of documents by hand. The plate is bent at 14*b* so that its downstream portion 14*c* is inclined only slightly relative to an imaginary horizontal plane and at an angle which is less than the angle of inclination of the portion having V-shaped notch 14*a*.

The downstream end of plate 14 is provided with three rectangular-shaped openings 14*e*, 14*f* and 14*g* providing clearance for the conveyor belts 27*a* and 27*b* (shown in phantom-line fashion) and the eccentrically mounted jogger wheel 15.

An inclined plate 16 is bent at 16*a* to form a lower portion 16*b*. Upper portion 16 is inclined at an angle which serves to relieve the major portion of the weight of the stack from the forward ends of the bottom-most document resting upon plate 14 and lying at a point below end 16*a*. Section 16*b* cooperates with a portion of the upper run of conveyor belts 27*a*, 27*b*, extending between roller 18 and roller 19 to define an entry throat through which the documents enter into the apparatus from the stack arranged in the infeed hopper.

Motor M, mounted to the frame member F1 of apparatus 10 by bracket 17, is drivingly coupled (by means not shown for purposes of simplicity) to a pair of rollers 20 (only one of which is shown in FIG. 1*b*) in order to impart rotation to the pair of rollers 19 and 18 by way of the pair of feed belts 27*a* and 27*b*. This arrangement is shown in detail in the above-mentioned copending application now U.S. Pat. No. 4,054,092 and a detailed description thereof will be omitted herein for purposes of simplicity. For purposes of understanding the present invention, it is sufficient to understand that the upper run of belts 27*a*, 27*b* extending between rollers 18 and 20 is adapted to move in the direction shown by arrow 21 as a result of counterclockwise rotation of roller pairs 18, 19 and 20 (rollers 20 being drive rollers and rollers 18 and 19 being driven rollers).

Drive from the feed belts is imparted to acceleration idler rollers 22 through frictional engagement between the O-rings 22*a* surrounding the periphery of idlers 22 and the roller 52 mounted on the shaft 20. These rollers, in turn, impart their rotation through flexible drive shaft assembly 23, frictional coupling means 24 and a second flexible drive shaft assembly 26 to rotate the upstream rollers 28 of the stripper assembly 30, which is also comprised of a pair of downstream rollers 29 freewheeling mounted upon shaft 29*a* and rotatably driven by the flexible resilient stripper O-ring pairs 31 and 32.

Rollers 28 are driven in the counterclockwise direction, as shown by arrow A2 of FIG. 1*a* in order to move the lower run of the stripper O-rings 31 and 32 in the direction shown by arrow 34, which is reverse that of the forward feed direction.

Since an accurate and thorough description of the manner in which the stripper O-rings and feed belts cooperate to strip and separate documents is set forth in the above-mentioned copending application, a detailed description will be omitted herein for purposes of brevity. For purposes of understanding the present invention it is sufficient to understand that the documents, when they enter between the stripper O-rings and the feed belts, are caused to be stripped, separated and fed in one-at-a-time basis in the following manner:

I. In the case where a single document is fed between the feed belts and the stripper O-rings, the material from which the O-rings is formed and the material from which the feed belts are formed, together with the manner in which the members are spatially positioned (FIG. 1*c*) and the saw-tooth pattern of the drive belts 27*a*, 27*b*, impart a corrugated shape to the sheet and cause the feed belts to exert a greater frictional drive in the forward feed direction upon the single sheet than the frictional drive imposed upon the same sheet by the stripper O-rings in the reverse direction thereby causing the document to be fed in the forward feed direction. The single fed sheet ultimately enters between and is engaged by the acceleration idlers' O-rings 22*a* which abruptly accelerate the sheet causing a gap to be formed between the upstream end of the sheet under the influence of the acceleration rolls and the downstream end of the next sheet moving toward the acceleration rolls. A suitable light source L and light detector D are positioned in the immediate vicinity of the acceleration rolls to detect the presence of a gap and thereby facilitate the counting of documents. This arrangement is also shown, for example, at 130 and 131 in FIG. 2*a* of abovementioned U.S. Pat. No. 4,054,092.

II. In the event that two or more documents are simultaneously fed between the stripper O-rings and the feed belts, the frictional force between the sheets is less than the frictional force exerted upon the top-most sheet by the stripper O-rings (which, as was described hereinabove, is a smaller frictional force than that exerted by the feed belts upon the bottommost document). As a result, the bottommost document is fed in the forward feed direction and the top-most document is fed in the reverse direction back toward the infeed hopper, or at least is prevented from being fed in the forward feed direction, to assure proper stripping of the documents and preventing double-feeds from occurring. Counting occurs in the same manner as was described hereinabove.

The feeding of documents which are extremely lightweight and thin and hence which have a tendency to become curled, creased or folded rather easily, imposes a severe burden upon the ability of the document handling and counting apparatus to adequately handle such documents. In order to assure that documents having folded or curled edges will be handled properly, the inclined plate 16 is fitted with a plurality of guide finger assemblies d40 of the type shown in FIGS. 2*a* and 2*b*. As shown therein, the guide finger assembly is comprised of a substantially rigid elongated rectangular-shaped plate 41 bent at 42 to provide an inclined lower portion 43. An opening is provided in inclined portion 43 for receiving a rivet 44 to secure the resilient spring steel finger 45 thereto. Member 45 is bent at 45*a*, 45*b* and 45*c* so as to form substantially straight portions 45A, 45B, 45C and 45D each respectively having a length D1, D2, D3 and D4. As can best be seen from FIG. 2*b*, the lower subportion D4″ of portion 45D extending beyond plate 41, as well as the portions 45A–45C are substantially narrower in width than the upper subportion D4″ of portion 45D, the upper subportion being of a width W1 substantially equal to the width of the rectangular plate 41 and the lower portions of member 45 being of a narrower width W2, which is a mere fraction of the width W1. In one preferred embodiment, $W_2 \leqq 0.2\ W_1$.

The plates 41 for mounting the resilient guide fingers 44 are provided with openings for receiving suitable fastening means to secure these plates to the inclined plate 16 of the infeed hopper 12 so that the marginal tips of the free ends of portions 45A of the resilient guide fingers are positioned between the O-ring pairs 31 and 32 as shown best in FIG. 1*a*. Considering the elevational view of FIG. 1*a*, it can be seen that the extreme free ends of the resilient fingers are positioned slightly inward of the outer periphery of the stripper O-rings 32 in the region of the lower run between rollers 28 and 29, which arrangement is provided to prevent documents from curling around and entering into the region R1 between the interior sides of the resilient guide fingers and the stripper O-rings entrained about the right-hand portions of rollers 28.

Considering FIGS. 1*a* and 2*a*, the lower bent portion 43 of member 41 and the lower subportion of resilient member 45 extending downwardly and to the left beyond portion 43 cooperate to define a diagonally aligned surface which serves to initially fan out the lower-most documents stacked in the infeed hopper to facilitate feeding of the documents in a one-at-a-time fashion between the stripper and drive apparatus.

The section 45C forms a rather severe angle with the feed belts, which angle is in the range from 10°–30° and preferably in the range from 15°–25°. Section 45C acts to press down curled, creased or folded edges against the drive belts 27*a*, 27*b* in order to assure positive drive of the curled, folded or creased document (or documents) between the stripper O-rings and the drive belts. This severe angle may cause documents having high frictional engagement with one another to be wedged in this region. Also the curled or folded edge of a document may become folded about one or more adjacent documents which can also cause wedging. However, due to the resiliency of member 45, member 45 will give or yield by moving upwardly to permit the documents to pass therebetween without tearing the documents and without damaging the mechanism. In the event that more than one document is fed between the stripper O-rings and feed belts they will be stripped and separated in the manner set forth hereinabove. The distinct advantage of the arrangement resides in the fact that light, fluffy documents which have an inherent tendency to curl, or documents of any thickness or stiffness having curled or folded downstream edges, are assured of being positively fed between the stripper O-rings and the feed belts due to the severe (i.e., small acute) angle defined by the resilient guide fingers and the belts 27*a*, 27*b*.

The portions 45A and 45B serve to prevent the documents from curling around and being wrapped around the guide fingers and also prevent documents experiencing any movement in the direction opposite from the forward feed direction from being torn or mutilated by the guide fingers.

In prior art embodiments, it is not possible to align the rigid guide finger at such a severe angle with the feed belt or drive belt, as the case may be, since the documents would jam or wedge continuously. Even though a severe angle is formed between the resilient guide and the feed belt, as shown in the present invention, the resiliency of the guide finger is selected to permit the documents to be fed therebeneath and thereby prevent a jam. The guide fingers also "give" sufficiently to prevent a severe crease from being imparted to curled documents fed beneath the guide fingers. The guide finger thus assures the feeding of light and/or curled documents that were virtually impossible to handle in conventional apparatus.

The spacing between the closest surface of the guide finger and the feed belts is of the order of one-third the smallest spacing employed in apparatus utilizing rigid guide fingers thus significantly increasing the downward forces applied to documents while at the same time providing sufficient resiliency to prevent jamming or wedging conditions when feeding stiffer and/or thicker documents.

Figure 5B:
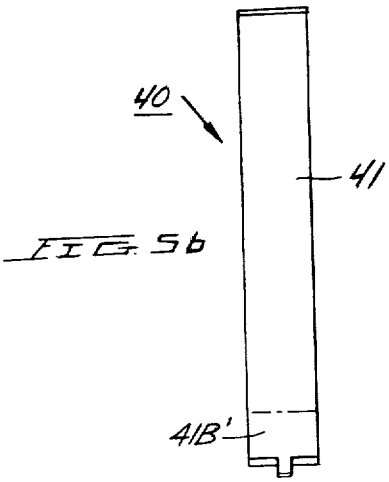
Figure 5A:
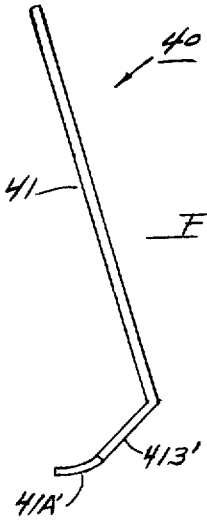
Figure 6B:
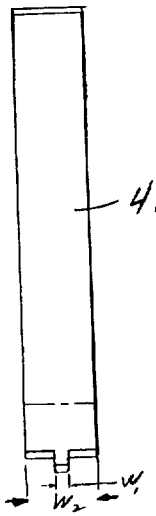
Figure 6A:
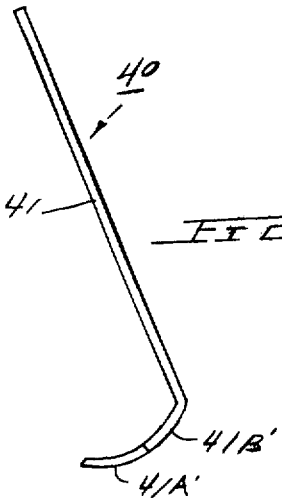
Figure 7B:
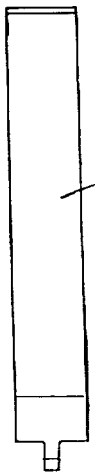
Figure 7A:
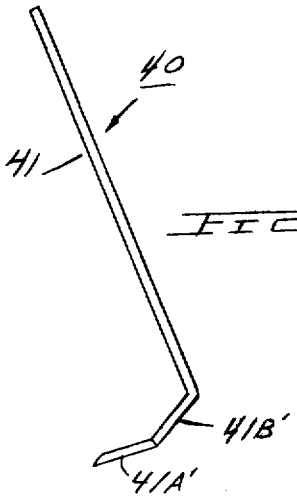

FIGS. 5a, 6a and 7a show other alternative embodiments for the resilient guide fingers, FIGS. 5b, 6b and 7b respectively showing front views of these preferred embodiments.

As shown in FIG. 6a, for example, the lower portion is provided with a substantially constant radius of curvature wherein the upstream portion 41B' has a width W2 and the downstream portion 41A' has a reduced width W1 similar to that shown in FIG. 2b. In the embodiment of FIG. 5a the section 41B' is substantially straight while the section 41A' has a predetermined radius of curvature. In FIG. 7a, both sections 41A' and 41B' are substantially straight.

The resilient guide fingers of all of the embodiments are preferably formed of a resilient material such as, for example, spring steel. However, any other suitable material may be employed such as, for example, a plastic material of appropriate resiliency.

Figure 9:
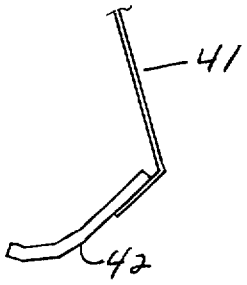

As a further alternative embodiment, the fingers may be formed of a material causing the fingers to be rigid and the rigid fingers may be resiliency mounted. As one example, consider FIG. 9 which shows the reverse arrangement from that shown in FIG. 2a wherein member 41 is formed of a spring steel material and member 42 is formed of a rigid material such as aluminum of appropriate gauge so as to be substantially incapable of bending insofar as the application of use of the invention is concerned. In this respect, the resilient mount 41 serves to provide the rigid finger 42 with the necessary "give" in the event that documents become wedged between the resilient finger 42 and the cooperating feed belt.

Obviously, the major portion of the mounting plate 41 may be formed of a rigid material, the finger may be formed of a rigid material and the resilient element may be positioned between the mounting plate and the finger and be riveted, for example, to each member as an alternative to having the entire mounting plate 41 being formed of the resilient material.

Figure 10:
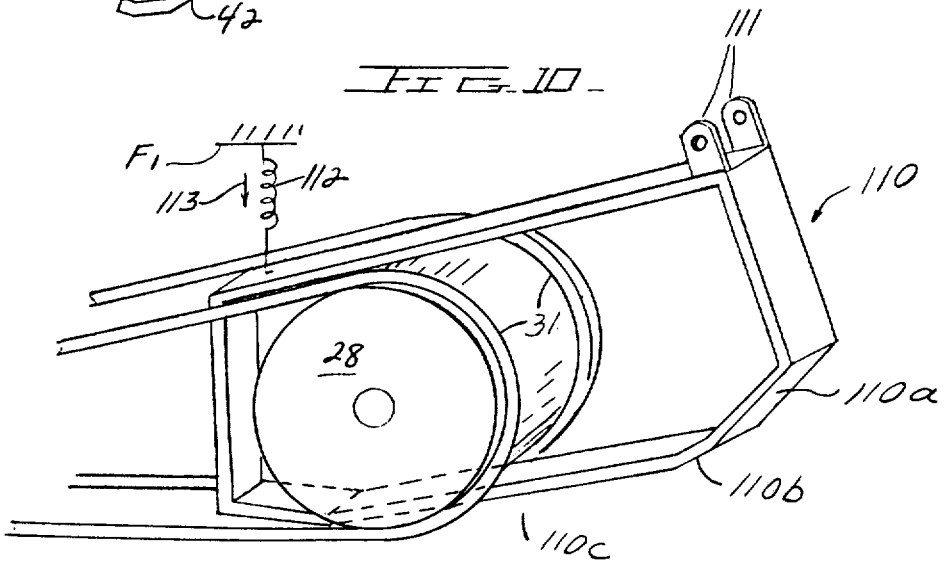

The embodiment of FIG. 10 shows another alternative arrangement in which a rigid finger assembly is swingably mounted at its forward end and is provided with cooperating resilient spring means. The frame structure 110 is provided with surface portions 110a, 110b and 110c which are angularly oriented relative to the feed belt in a manner similar to the portions 45C, 45B and 45A respectively, of the embodiment of FIG. 2a. The upper right-hand corner of the frame is provided with a pair of projections 111 for swingably mounting the frame to a pin (not shown) supported on the frame of the document handling device.

The left-hand portion of the frame (relative to FIG. 10) substantially surrounds the periphery of the stripper roll so as to be positioned between the pair of O-rings and hence not obstruct the movement of the upstream rollers 28 and hence the O-rings 31. A spring 112 has its upper end fixed to the machine frame at $F_1$ and is adapted to exert a downward biasing force represented by arrow 113 upon the free end of the frame so as to enable the guide surface 110a, 110b and 110c to exert a downward force upon the incoming documents which is nevertheless capable of yielding in the event of an incipient jam condition.

Figure 8A:
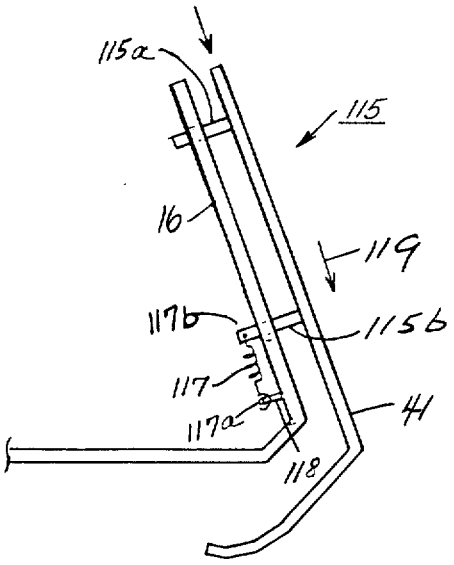
Figure 8B:
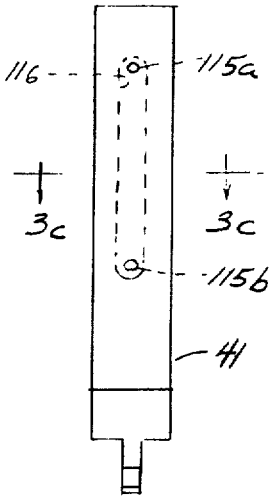
Figure 8C:
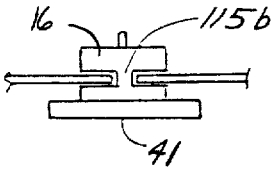

Still another embodiment of the present invention is shown in FIGS. 8a–8c wherein a rigid guide finger assembly 115 is provided with a pair of rearwardly extending projections 115a and 115b, one such projection being shown in top plan view in FIG. 8c, which projections extend through an elongated slot 116 provided in plate 16 (note also FIG. 1a) to enable the finger assembly to be slidably moved. A helical biasing spring 117 has its lower end 117a fixed to the machine frame by a pin 118, while its upper end 117b is fixed to the lower projection 115b of finger assembly 115 so as to urge the finger assembly generally in the downward direction as shown by arrow 119 thereby providing a rigid guide finger which, nevertheless exhibits the appropriate amount of resiliency in the event of an incipient jam condition.

In still another embodiment of the present invention, the entire plate 16, as shown in FIG. 1a and 1b, may be resiliently mounted. For example, its upper ends at opposite sides thereof may be provided with torsion type biasing springs 120 for urging the entire plate 16 downwardly in the direction shown by arrow 122 so as to provide the otherwise rigid guide fingers, which are intergrally formed as part of the plate 16, with the appropriate amount of resilience for the reasons set forth above.

As was set forth hereinabove, documents which have been stripped, separated and counted leave the influence of the acceleration rollers and move between a pair of guide plates 51 and 52 shown best in FIG. 1a, which guide plates are respectively provided with suitable openings for enabling the acceleration idler O-rings 22a and the surface of roller 54 to protrude therethrough in order to frictionally engage documents passing through the guideway G to be rapidly accelerated and fed into the stacker apparatus 60.

The downstream edge of the accelerated document strikes the undersurface of a pivotally mounted generally S-shaped stacker guide plate 61 (note FIGS. 1a, 3a and 3b).

The upstream end of the stacker plate is bifurcated to form first and second mounting arms 61a and 61b which are bent at their upper ends to form generally circular mounting openings for receiving pivot pins upon which the stacker plate is swingably mounted.

The opening 62 in arm 61a receives a pin 72 which is secured to the upper surface of guide plate 51 (see FIG. 1a) by a suitable bracket 73.

Figure 4A:
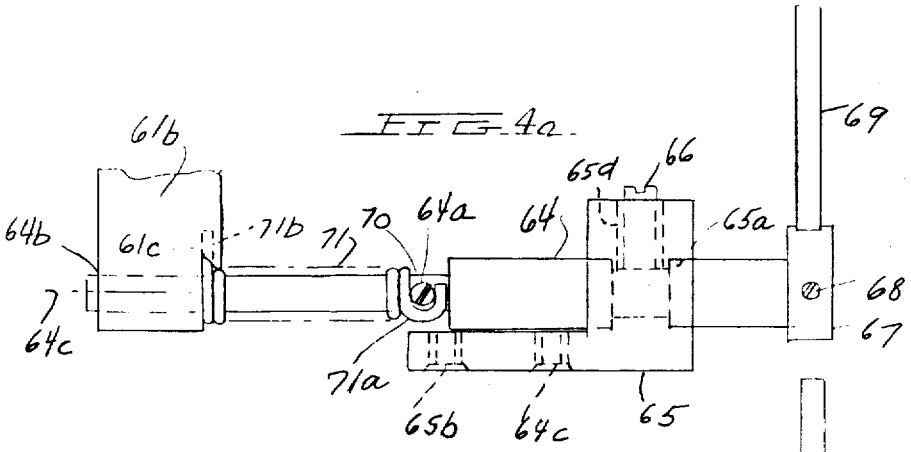
Figure 4B:
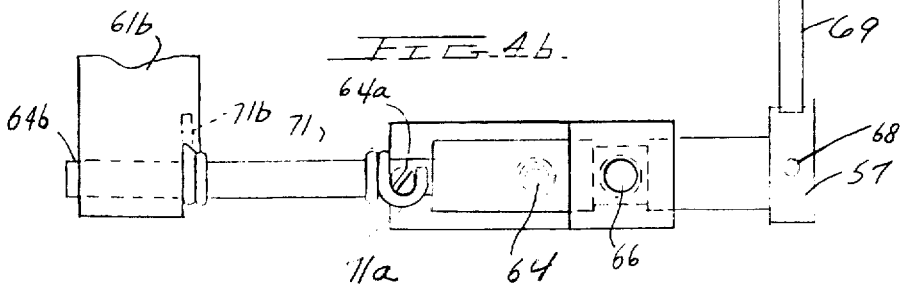

The opposite arm is also swingably mounted upon a pin 64, shown best in FIGS. 4a and 4b. One end of pin 64 is positioned within an opening 65a in a mounting bracket 65 having a pair of openings 65b and 65c for securing bracket 65 to the upper surface of plate 51 (FIG. 1a). A threaded opening 65d communicates with opening 65a and receives a threaded fastener (set screw) 66 for locking pin 64 at any desired angular orientation.

The pin extends to the right of opening 65a and has a coller 67 secured thereto by means of a set screw 68. A handle 69 extending radially outward from collar 67 serves as the means for adjusting the angular orientation of pin 64.

Pin 64 is provided with a threaded opening 64a for receiving a fastening member 70.

The left-hand portion 64b of pin 64 extends through the center of a helically wound torsion spring 71. The fastening member 70 embraces the hooked end 71a of spring 71. The opposite end of spring 71 terminates in a straight portion 71b which is aligned with a notch 61c provided in stacker plate arm 61b and extends along the undersurface of arm 61b. The adjustable lifting force exerted by torsion spring 71 upon the stacker guide plate 61 may be adjusted by rotating pin 64 about its longitudinal axis (phantom line 64*c*) which adjustment is facilitated by the lever 69. The desired adjustment is maintained by tightening set screw 66 against the surface of pin 64 beneath the threaded opening 65*d*. The force is adjusted so that the stacker guide plate preferably exerts a downward force upon the stack of documents which is of the order of a few ounces and preferably as small as an ounce or less. The axial length of the torsion spring (which is controlled by controlling the number of turns of the helical spring about pin 64 for a given material) is selected so as to maintain the lifting force exerted upon the stacker plate constant over the range of movement of the stacker plate which is typically of the order of 40° to 60° between the empty and the full positions. The small downward force exerted upon the stack by the guide plate assures unimpeded stacking of light, fluffy documents.

Considering especially FIG. 3*a*, the stacker guide plate can be seen to have a substantially constant radius of curvature R over the arcuate segment lying within a section having an angle $\theta$. The succeeding sections 85, 86, 87 and 88 are substantially straight and planar, being integrally joined to one another at the bends 84*a*, 85*a*, 86*a* and 87*a* respectively, said bends 84*a*–86*a* each forming convex vertices and said bend 87*a* forming a concave bend along the bottom surface of the guide plate.

The curvature of portion 84 is provided to guide the downstream edge of the document being fed into the stacker assembly gradually and continuously downward toward the downstream-most end of the stacker such that the downstream end of a document reaches and engages the interior or right-hand edge of stop flange 88 of the stacker plate.

As documents are fed in this fashion, the stacker guide plate 61 is caused to be lifted (i.e. rotated clockwise about the axis A of the coaligned pivot pins 64 and 72). The length of portion 87 (of the order of $\frac{1}{8}$ to $\frac{3}{8}$ inches) is short enough to allow the sheets to reach and strike the stop flange 88, since the cumulative amount of sliding friction (i.e. frictional "drag") imparted to the sheets is small due to the short length of portion 87. The effectiveness of the snapping action imparted to the sheets to abruptly move the rearward ends of the sheets downward is a function of the length of the portion and the downward force of the guide plate generally localized at vertex 86*a*. Since the height of the stack is quite small when it is under the influence of vertex 86*a* and portion 87, the snap-action need not be large since more than adequate clearance remains for passage of sheets subsequently fed to the stacker.

As the height of the stack increases, the planar portion 86 of stacker plate 61 more closely approaches parallel alignment with the top surface of the stack (i.e. with the horizontal direction). At the time that the height of the stack builds to this point, the vertex at bend 85*a* continues to engage the surface of the stack while the vertex at 86*a* is still further displaced from the surface of the stack thus creating a downward force upon the stack a predetermined distance $D_F$ inward from the downstream end of the stack. This downward force F represented by the vector shown in FIG. 3*a*, is localized at bend 86 and is of the nature of a torque-like force exerted upon the document and tending to twist or flip the forward end of the document in a substantially upward and clockwise direction causing the upstream or right-hand end of the document (relative to FIGS. 1*a* and 3*a*) to be abruptly flipped or snapped downwardly so that the upstream end will thereby be pulled away from the path of the next document to enter into the stacker to assure neat and orderly stacking. The force $D_F$ becomes effective whenever a document engages vertex 86.

The effectiveness of the snapping action increases considerably when the top of the stack engages vertex 85*a*. However, the sheets also experience an increased amount of "drag" as a result of the increased length of planar portion 86. The result is that the forward ends of the sheets fail to reach the stop flange 88 and, in fact, the forward ends do not even reach the vertex 86*a*. As a result there is a limit to the optimum length of the planar portion 86. The preferred range (i.e. between vertices 86*a* and 85*a*) is $1\frac{1}{8}$ inches to $1\frac{3}{8}$ inches and preferably closer to $1\frac{3}{8}$ inches.

The document handling device is designed to handle documents averaging three (3) inches in length (measured in the feed direction) and preferably no smaller than 2 inches and no greater than $4\frac{1}{2}$ inches. Thus, for documents in this range, the length ranges of planar portions 86 and 87 as given hereinabove will handle and stack even very light, fluffy sheets in a neat and orderly fashion.

Experimentation using high-speed photography has indicated that in stackers utilizing conventional stacker plates, the downstream end of the document impacts the stop flange 88 of the stacker guide plate (or its equivalent), while the upstream end "floats" down toward the floor 90 of the stacker. In contrast, the stacker guide plate of the present invention, and especially its curved portion 84, together with the vertex at 85*a*, serve to cause the upstream end of the document to be abruptly flipped or snapped downwardly against floor 90. This has been found to be the case even when stacking light, fluffy documents. The downward snapping of the upstream end of the document assures that the upstream end will remain displaced from the path of the next document to enter the stacker for a period sufficient to assure orderly entry and stacking of documents.

The snapping or torque-like force may be significantly magnified by either tilting the entire floor 90 of the stacker assembly so as to be arranged in the dotted alignment 90' shown in FIG. 3*a*. Alternatively, the major portion of the floor may be horizontal as shown by phantom line 90*a*" while the downstream-most portion may be inclined as shown at 90*b*". As shown in FIG. 6, vectors $F_1$ and $F_2$ represent the forces exerted by the vertex 85*a* and the extreme end 90*d*" of the stacker floor 90*c*" upon each document as it enters into the stack S. The magnitudes of the forces $F_1$ and $F_2$ and the spacing distance L therebetween determine the resultant torque-like force exerted upon each sheet to further enhance the snapping or flipping down of the upstream or rearward end (RE) of each sheet as it enters neatly upon the already formed stack to thereby assure that the rearward end will be out of the path of movement of the next document entering the stacker as represented by the arrow $M_P$. Preferably the distance between stop flange 88 and vertex 86*a* is in the range from $\frac{1}{8}$ to $\frac{3}{8}$ inches or alternatively in the range of from 1/32 to 1/16th of the length of the average document being processed (said length being measured in the direction of feed). The length range for portion 85 is preferably between $\frac{2}{3}$ to $\frac{1}{4}$ the length of a document, for the ranges given herein as well as for increased or decreased ranges.

Thus, the curved portion 84 of the stacker guide plate, together with the portions 85, 86 and 87 serve to provide a sharper curvature along which each incoming document moves together with the torque-like forces imparted to cooperatively enhance and optimize the snapping action experienced by the rear end of the document to assure neat, orderly, high-speed stacking.

Although there has been described a preferred embodiment of this novel invention, many variations and modifications will now be apparent to those skilled in the art. Therefore, this invention is to be limited, not by the specific disclosure herein, but only by the appending claims.

What is claimed is:

1. Guide means for use in a document handling device adapted to separate a stack of documents presented to the device and to restack the documents after separation thereof, said device comprising:

an infeed hopper for supporting a plurality of sheets generally arranged in a stack;

said hopper having an outfeed passageway at one end thereof through which at least the bottom sheet may pass;

the base of said infeed hopper including continuously moving closed loop conveying means having an elongated upper run positioned to one side of the outfeed passageway such that the upstream portion of said upper run protrudes at least partially through said opening for advancing at least the bottom sheet of said stack toward and through said outfeed passageway;

continuously movable closed-loop stripper means including a pair of closely spaced stripper surfaces being arranged adjacent to and to the opposite side of said outfeed passageway and having an elongated lower run positioed adjacent to an intermediate portion of the upper run of said conveying means, said lower run being moved in a direction opposite the upper run of said conveyor means and engaging passing sheets for permitting only a single sheet passing between said stripper means and said conveyor means to be advanced toward said outfeed location;

said closed loop stripper means and said closed loop conveying means cooperating to impose a corrugated shape to the sheets to permit only that sheet which makes sliding engagement with the upper run of said conveying means to be fed towards the outfeed location and in the event of multiple sheets being fed therebetween, enabling only the bottommost sheet to move beyond the downstream end of said stripper means in moving toward the outfeed location;

guide means comprising a resilient assembly including a guide member positioned in front of said stripper means and having an inclined surface positioned above the upper run of said conveying means for engaging the downstream edge of documents before they engage the stripper means, to fan the documents as they move towards said stripper means and having a free end positioned between the stripper surfaces for urging the downstream edges towards the upper run of said conveying means to facilitate separation and counting, said inclined surface portion being adapted to yield to prevent documents from being jammed between the guide means and the conveying means.

2. The apparatus of claim 1 wherein said inclined surface forms an angle with the upper run of said conveying means which lies in the range from 10° to 30°.

3. The apparatus of claim 2 wherein the preferred range of said angle is from 15° to 25°.

4. The apparatus of claim 1 wherein said stripper means comprises a stripper roller having a pair of spaced friction drive means entrained about and extending outwardly from the periphery of said roller;

the downstream end of said guide member being positioned between said drive means and inwardly of the outer periphery of said friction drive means to prevent documents from moving between said resilient member and said friction drive means.

5. The apparatus of claim 4 wherein said friction drive means comprises resilient O-rings for slidingly engaging documents fed to the stripper means.

6. The apparatus of claim 5 wherein said stripper roller is provided with annular grooves for seating and positioning said O-rings.

7. The apparatus of claim 1 wherein said infeed hopper comprises an inclined plate positioned in front of the guide member for engaging the edges of documents arranged in a stack which has been placed in the hopper;

said guide means including mounting means for mounting one end of said member to said plate;

said guide member being secured to the lower end of said mounting means so as to be suspended in front of said stripper means.

8. The apparatus of claim 7 wherein said mounting means is a resilient member and said member is substantially rigid.

9. The apparatus of claim 8 wherein the stripper means comprises a pair of spaced stripper surfaces for engaging said sheets; the width of the free end of said guide member being smaller than the distance between surfaces and extending into said space to prevent sheets from becoming wedged in the region between the confronting surfaces of said stripper means and said guide member.

10. The apparatus of claim 8 wherein the guide member is formed of spring steel.

11. The apparatus of claim 7 wherein said mounting means is a substantially rigid member and said member is substantially a resilient member.

12. The apparatus of claim 11 wherein the guide member is formed of spring steel.

13. The apparatus of claim 11 wherein said inclined surface forms an angle with said conveying means which lies in the range from 10° to 30°.

14. The apparatus of claim 7 wherein said member is a substantially rigid member having a projecting portion and said mounting means comprises means for slidably receiving said projecting member to limit movement of said member along a linear path transverse to the upper run of said feed conveyor means;

resilient means for normally urging said guide member towards said upper run.

15. The apparatus of claim 7 wherein said guide member is rigid and comprises means for swingably mounting the end of the guide member in front of the stripper means, the free end of said guide member extending towards said passageway between the stripper means and conveying means;

resilient means for normally urging the free end of said guide member towards the upper run of said conveying means.

16. The apparatus of claim 7 wherein said stripper means comprises a pair of spaced parallel O-rings; the free end of said resilient member being of reduced width as compared with the end of said member joined to said mounting means, the edge of said free end being positioned between said O-rings.

17. The apparatus of claim 7 wherein said inclined surface forms an angle with the upper run of said conveying means which lies in the range from 10° to 30°.

18. The apparatus of claim 17 wherein the first portion of said guide member is positioned a spaced distance from said mounting means forms an angle $\theta$ of between 15° to 25° with the plane of the upper run of said conveying means;

said guide member having a bend at a location intermediate the first portion and the edge of said free end to provide a second portion forming an angle $\phi$ with the plane of said conveying means where $\phi < \theta$.

19. The apparatus of claim 18 wherein the surface of said second portion is substantially parallel to the upper run of said conveying means.

20. The apparatus of claim 19 wherein G represents the gap between the surface of the upper run of said conveying means and the surface of said finger second portion and wherein 0.01 inch $< G <$ 0.03 inch.

21. The apparatus of claim 18 wherein said guide finger portion has a curved surface.

22. The apparatus of claim 1 wherein said infeed hopper comprises an inclined plate for engaging the forward edges of the stack of documents in the hopper;

said guide means being integral with said inclined plate and arranged at the lower end of the inclined plate adjacent to said outfeed passageway;

resilient bias means normally urging said plate and hence said guide finger downwardly toward the upper run of said conveying means.

23. The apparatus of claim 22 wherein the first and second portions of said guide member define a curved convex surface.

24. The apparatus of claim 1 wherein said conveying means comprises first and second spaced parallel closed loop belt drive means and said stripper means comprises first and second stripper assemblies cooperating with each belt drive means, each having a cooperating guide means.

* * * * *